United States Patent [19]

Fleissner

[11] Patent Number: 4,624,023

[45] Date of Patent: Nov. 25, 1986

[54] PROCESS AND APPARATUS FOR WASHING TEXTILE MATERIAL

[75] Inventor: Gerold Fleissner, Chur, Switzerland

[73] Assignee: Fleissner GmbH & Company, Fed. Rep. of Germany

[21] Appl. No.: 656,504

[22] Filed: Oct. 1, 1984

[30] Foreign Application Priority Data

Sep. 30, 1983 [DE] Fed. Rep. of Germany ..... 3335542

[51] Int. Cl.[4] ..... D06B 1/14; D06B 23/00

[52] U.S. Cl. ..... 8/151; 26/2 R; 68/13 R; 68/20; 68/202

[58] Field of Search ..... 68/13 R, 202, 5 D, 5 E, 68/20; 26/2 R; 100/121, 156, 154; 29/121.1, 121.5, 121.6; 8/151

[56] References Cited

U.S. PATENT DOCUMENTS 4,524,589 6/1985 Fleissner ..... 68/202 X

*Primary Examiner*—Philip R. Coe

*Attorney, Agent, or Firm*—Antonelli, Terry & Wands

[57] ABSTRACT

A process for washing textile material wherein a non-foamed washing liquor, combined with a foam-producing chemical, is applied to a continuously fed textile material, the foam is produced on the textile material by effecting alternating compression and pressure relief of the textile surface while simultaneously loosening the dirt, and finally the foam, and thus the dirt dissolved in and taken up by the foam, is removed by suction.

4 Claims, 2 Drawing Figures

PROCESS AND APPARATUS FOR WASHING TEXTILE MATERIAL

Figure 1:
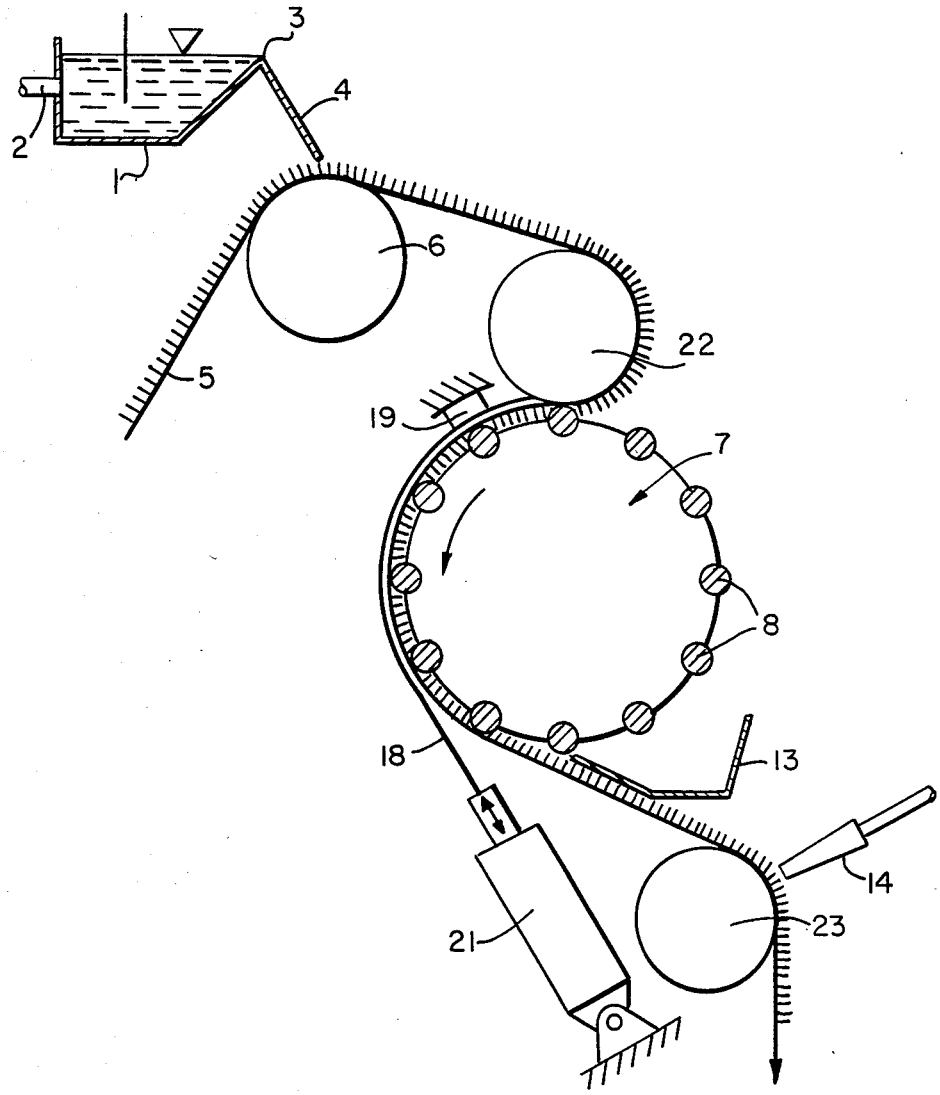

This invention relates to a process and apparatus for washing textile material wherein a foamable washing liquor is applied to a continuously fed textile material, a foam is produced on the textile material by effecting alternating compression and pressure relief of the textile, which also loosens the dirt within the textile material, and then the dirt and foam are removed by suction.

It is known to wash carpets, for example, with a foam. In household usage, a laundry concentrate is introduced, for this purpose, into a bucket of water, the foam is produced in the bucket, then the foam is applied to the carpet and, to remove the dirt, the foam is worked into the carpet and then rubbed off. Foam is also customarily used in industrial washing of carpets. According to DOS No. 2,903,134, a foam is likewise applied to the side of the textile material to be washed, the foam is then worked into the textile material by being sucked through the carpet, and is then removed together with the detached dirt. It has been found under practical conditions that simple application of foam, for example to the back of a continuously fed permeable carpet, and a subsequent suction removal of this foam through the carpet in the direction of the pile face, is inadequate for a sufficient, clean washing of the continuously fed carpet.

Starting with a process of the type heretofore described, wherein likewise foam is employed for laundering the textile material and, in this respect, a process very favourable from the viewpoint of prevention of environmental pollution is carried out, it is an object of the invention to develop a process which will obtain an adequate laundering result even with a continuously fed length of textile material.

In order to attain the posed objective, the invention provides that a continuously fed textile material is continuously wetted with a non-foamed, washing liquor containing foam-producing chemicals, e.g. foamable detergents; thereafter dirt-loosening foam is produced on the surface of the textile material by an alternating compression and pressure relief, such as by stroking, flexing, massaging or the like, of the surface of the textile material, thus loosening the dirt; and subsequently the foam is continuously removed by suction together with dirt removed from the textile material. The washing liquor may be a solvent or may be an aquaous solution containing the foamable or foam-producing chemicals. The advantage of this process resides, therefore, in the feature that the dirt-loosening foam is only produced on the textile material and, during production is simultaneously worked into the surface of the textile material for example a pile carpet. By this frequent stroking and pressing of the pile carpet, for example, the pile threads are simultaneously subjected to intensive working over their entire length, so that the foam comes into contact with each fiber and can loosen any dirt that may be present. This method is advantageous not only for the detachment of usual dirt, but also is especially advantageous for the washing step that is always required after a dyeing or printing process during carpet manufacture. It is advantageous to have this washing step followed by a rinsing step, likewise in a continuous method, and then to dry the carpet. For the rinsing procedure, a rinsing liquid, e.g. water, also is only to be sprayed—but in this case onto the back of the carpet—and then is to be immediately removed by suction. This procedure saves energy and water during washing and drying.

It is especially advantageous to apply the non-foamed washing liquor to the textile material in a hot state, thus combining a hot-laundering step, which, as is known, is an intensive operation, including suction removal, with the foam washing step.

The apparatus for conducting the process can be easily assembled. As the applicator for the foaming agent, a device can extend over the textile material distributing a thin film, according to the pouring principle, uniformly over the textile material. However, it is also possible to apply the foaming agent by spraying or by a doctor blade. The foam-producing device is suitably one of the type described in DOS Nos. 3,045,644 or 3,101,337 (and corresponding U.S. application Ser. No. 326,279, filed Dec. 1, 1981, now U.S. Pat. No. 4,524,589). This device has proven itself well for producing a foam for the dyeing step, and can also be advantageous for the washing operation.

Suction removal of the foam generated during stroking and pressing on the surface of the textile material takes place as usual, by having a suction removal means effective on the face or pile side of the carpet, thus removing, on account of the suction draft, the foam and therefore the dirt from the textile material. Generally customary rinsing devices, as indicated above, should follow the suction removal means.

Figure 2:
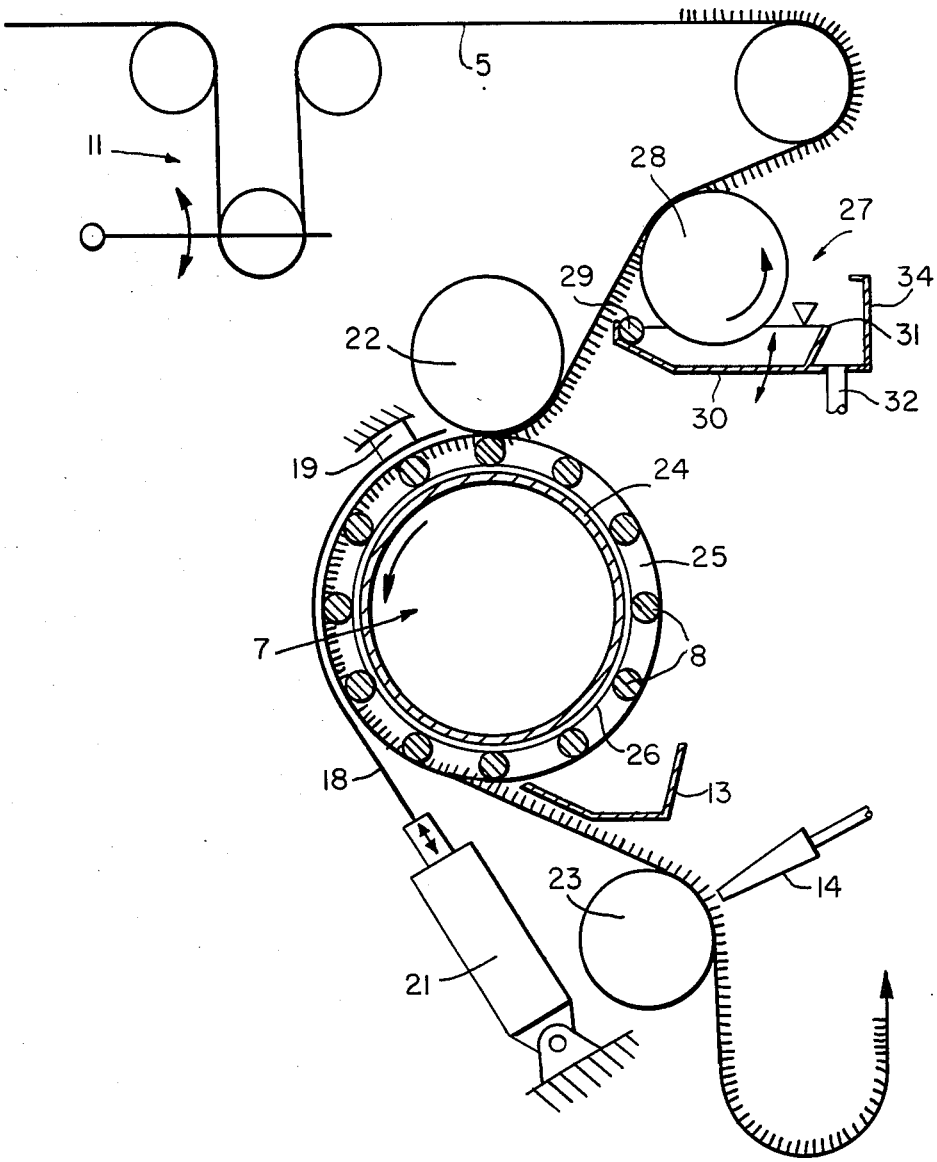

The process of this invention will be further understood from the following detailed description and with reference to the accompanying drawings wherein:

FIG. 1 is a schematic view of an apparatus for carrying out the process of the invention wherein a stroking unit having a single contact reel for stroking the textile material is arranged downstream of an applicator device for applying the washing liquor to the continuously fed textile material; and FIG. 2 shows an apparatus similar to that shown in FIG. 1 with a differently constructed reel and with a padder as a washing liquid applicator.

Reference numeral 1 in FIG. 1 denotes a washing liquor applicator which operates according to the pouring principle. The non-foamed washing liquor, e.g. water, combined with foam-producing chemicals, e.g. a foamable detergent, is filled into the container via a pipe 2 and flows from there via an overflow edge 3 uniformly over the operating width along the doctor blade 4 onto the textile material 5 having pile fibers on one side thereof and traveling directly underneath. Following the guide roller 6 arranged underneath the drip edge of the doctor blade 4, and a subsequently arranged guide roller, a reel 7 is located below guide roller 22. The reel is looped about by the length of pile material from above, whereby the pile side is pressed against the fixed round bars 8 provided on the reel. In order to obtain the uniform longitudinal tension in the length of material, essential at this point, this massaging or stroking unit has a compensator 11 (as shown in FIG. 2) connected in front thereof, which compensator regulates the tension of the material in a conventional way.

The reel 7 is driven in the direction of the arrow, i.e., in the conveying direction of the length of material. With a material delivery speed of up to 20 meters/minute, a rotational speed of the reel of, for example, 80 rpm is contemplated. At this low rotational speed, the pile fibers are slightly compressed and again relieved, whereby on the one hand all fibers and all fiber parts are wetted with the washing liquor and on the other hand the development of a foam is effected during each relief. In order to be able to catch any dripping liquid and/or superfluous foam, a collecting trough 13 is arranged underneath the reel 7.

A suction device 14 associated with the pile side of the length of material 5 is additionally provided upstream of the rinsing unit or other processing devices which follow thereafter. The rinsing unit is not illustrated. This suction device acts on the pile material to effect removal of the foam and loosened dirt and also an uprising of the pile which may have become matted down.

The length 5 of material is to be guided around the reel 7 with a certain longitudinal tension. However, this tension in most cases is not sufficient to urge the air contained in the pile of the textile material out of this pile to thereby develop a foam from the previously applied liquid reaching down to the pile roots. According to FIG. 1, a cover means in the form of a steel belt 18, for example, loops for this purpose around the reel 7 on the side covered by the textile material, which steel belt is fixedly attached to a beam 19 on the feed side of the textile material and thereafter is held under controllable tension via a spring or a compressed-air cylinder 21.

It is advantageous in connection with the cover means 18 that this means not only urges the length 5 of material firmly against the reel 7, but that also the back of the length 5 of material becomes air-impermeable. This has the effect that the relief ["breathing"] taking place after each compressing exerted by the respective round bar 8 occurs only on the pile side or on the side treated with the liquid, without participation by the air present on the rear side of the length of material. This, however, is only possible if the rear side of the length 5 of material is air-impermeable which is accomplished in a simple way at the moment of massage of the length 5 of material on the front face by means of this air-impermeable cover belt 18. To attain a satisfactory treatment effect, the contact pressure must be uniformly distributed over the working width of the material. It has been found that a synthetic resin belt with fabric insert is best suited for this purpose, since dents may be produced in certain circumstances in a steel belt, which can no longer be straightened out by vigorous stretching.

As shown in FIG. 1, the apparatus elements 22, 7, and 23 are arranged approximately in mutual superposition, whereby the device is not only built in a compact fashion but also offers the feature that the surplus foam produced at the reel 7 can be collected more readily by the trough 13 so that the foam does not stick improperly to the length of material. This occurrence would result in a nonuniform distribution of the foam on the length of material. Also, the apparatus, in this alignment of the apparatus elements with respect to one another, can be more readily supervised by an operator and can be more easily operated. The direction of rotation of the reel is in this case advantageously in the same direction as the conveying direction of the length 5 of material. The rotational speed of the reel is controlled to be faster than the movement of the length of material. The foam adhering to the bars 8 will drip down during the upward travel and will thus be caught by the trough 13.

The reel 7 can be built as illustrated in FIG. 1. It is more advantageous to use a reel as shown in FIG. 2 according to which it is made of a metal cylinder 24 with annular disks 25 at the end faces, the round bars 8 being mounted in these disks at a small spacing from the cylinder 24. Accurately machined spacer rings 26 are attached at intervals to the cylinder 24, the round bars 8 being supported at multiple points along their lengths on the cylinder 24 by these spacer rings. This construction has the advantage that the reel 7 is self-cleaning, although the bars have repeated contact points along their lengths and thus bending deformation of the bars is prevented even over a relatively large operating width. In case of a change in the washing liquor, the reel can also be readily cleaned, which would not as easily be possible in case of a direct contact of the round bars 8 on the cylinder 24 and over the entire length of the cylinder.

The contact pressure or cover means is fashioned as an elastic belt. Although this ensures a satisfactory hugging of the bars 8 by the textile material, the belt will wear more quickly due to the frequent flexural change and due to the friction.

FIG. 2 shows a padder 27 as the liquid applicator; this padder makes it easier to apply a smaller quantity of washing liquor to the length 5 of material in a uniform fashion than a device operating according to the pouring principle.

The padding roller 28, partially covered by the length 5 of material, dips into a basin 30, pivotably mounted about the axle 29; on the longitudinal edge opposite to the pivot 29, this trough has an overflow edge 31 over which the excessive amount of liquid introduced via a conduit (not shown) can flow away and can be discharge via conduit 32. In order to collect the liquid discharged via the overflow edge 31, a collecting trough 34 is mounted to the basin 30, the discharge pipe 33 terminating in this collecting trough. Flowmeters in the feed and discharge conduits can measure the difference of the amounts of liquid fed and discharged and thereby can effect control of the liquid necessary for the washing step.

What is claimed is:

1. A process for washing textile material, especially pile-type carpets, by working foam into the textile material and by removing the foam thereafter, characterized in that a pile side of a continuously fed textile material is continuously wetted at an elevated temperature with a non-foamed washing liquor containing a foam-producing chemical, the foam is produced thereafter on the pile side of the textile material by alternating compression and pressure relief of the surface of the textile material by contacting the surface with a stroking means, thus loosening the dirt, and, for dirt removal, the foam is subsequently continuously removed by suction from the pile side of the textile material.

2. An apparatus for foam washing of a continuously fed length of textile material having a pile surface on one side which comprises a plurality of series-arranged textile-treating means associated with the textile material including (a) an applicator means for applying a foam-producing liquid to the pile side of the textile material;

(b) a foam-producing device which controls the liquid wetted textile material and which alternatively effects compression and pressure relief thereof on the pile side of the textile material; and (c) suction means for removing the foam and loosened dirt or like particles from the pile side of the textile material.

3. An apparatus according to claim 2 further comprising means for transporting the length of textile material through said series-arranged textile-treating means.

4. A process according to claim 1, further comprising passing the foam-containing textile material over a guide roller to cause the pile to become arranged opposite to a device for applying suction to the pile side of the textile material whereby matted down pile is raised during application of the suction.

* * * * *